US009827805B2

(12) United States Patent
Argoitia et al.

(10) Patent No.: US 9,827,805 B2
(45) Date of Patent: Nov. 28, 2017

(54) OPTICALLY VARIABLE DEVICE COMPRISING MAGNETIC FLAKES

(71) Applicant: Viavi Solutions Inc., Milpitas, CA (US)

(72) Inventors: Alberto Argoitia, Santa Rosa, CA (US); Cornelis Jan Delst, Fairfax, CA (US); Patrick Laden, Petaluma, CA (US)

(73) Assignee: Viavi Solutions Inc., Milpitas, CA (US)

( * ) Notice: Subject to any disclaimer, the term of this patent is extended or adjusted under 35 U.S.C. 154(b) by 362 days.

(21) Appl. No.: 14/710,108

(22) Filed: May 12, 2015

(65) Prior Publication Data

US 2015/0321499 A1 Nov. 12, 2015

Related U.S. Application Data

(60) Provisional application No. 61/992,093, filed on May 12, 2014.

(51) Int. Cl.

| | |
|---|---|
| ***B42D 25/369*** | (2014.01) |
| ***B05D 3/00*** | (2006.01) |
| ***H01F 7/02*** | (2006.01) |
| ***B05D 5/06*** | (2006.01) |
| ***B05D 1/16*** | (2006.01) |

(52) U.S. Cl.

CPC ..... *B42D 25/369* (2014.10); *B05D 1/16* (2013.01); *B05D 3/20* (2013.01); *B05D 3/203* (2013.01); *B05D 5/065* (2013.01); *H01F 7/0273* (2013.01); *B05D 2451/00* (2013.01); *Y10T 428/24802* (2015.01); *Y10T 428/24893* (2015.01)

(58) Field of Classification Search

None

See application file for complete search history.

(56) References Cited

U.S. PATENT DOCUMENTS

| | | | | |
|---|---|---|---|---|
| 6,103,361 | A | 8/2000 | Batzar et al. | 428/323 |
| 6,808,806 | B2 | 10/2004 | Phillips et al. | 428/403 |
| 7,047,883 | B2 | 5/2006 | Raksha et al. | 101/489 |
| 7,258,900 | B2 | 8/2007 | Raksha et al. | 427/548 |
| 7,420,663 | B2 | 9/2008 | Wang et al. | 356/72 |
| 7,517,578 | B2 | 4/2009 | Raksha et al. | 428/195.1 |
| 7,934,451 | B2 | 5/2011 | Raksha et al. | 101/375 |
| 8,164,810 | B2 | 4/2012 | Phillips et al. | 359/2 |
| 8,211,509 | B2 | 7/2012 | Raksha et al. | 427/547 |
| 8,343,615 | B2 | 1/2013 | Raksha et al. | 428/195.1 |
| 8,511,712 | B2 | 8/2013 | Raksha et al. | 283/91 |
| 2005/0106367 | A1 | 5/2005 | Raksha et al. | 428/199 |
| 2006/0279732 | A1 | 12/2006 | Wang et al. | 356/326 |

(Continued)

FOREIGN PATENT DOCUMENTS

| | | | |
|---|---|---|---|
| EP | 2062947 | 11/2010 | C09C 1/00 |
| EP | 1745940 | 12/2013 | B41M 3/14 |

*Primary Examiner* — Gerard Higgins

(74) *Attorney, Agent, or Firm* — Harrity & Harrity, LLP

(57) ABSTRACT

An optically variable device may be manufactured by aligning magnetic flakes on a surface of an adhesive layer by applying the flakes onto the adhesive layer surface in presence of a magnetic field, and curing the adhesive layer having magnetic flakes adhered to the adhesive layer. When cured, the adhesive layer holds the magnetic flakes oriented, enabling subsequent encapsulation of the oriented magnetic flakes in a coating layer on the adhesive layer, without a substantial loss of orientation of the magnetic flakes.

22 Claims, 15 Drawing Sheets

(56) References Cited

U.S. PATENT DOCUMENTS

| | | | | |
|---|---|---|---|---|
| 2009/0072185 | A1 | 3/2009 | Raksha et al. | 252/62.51 R |
| 2010/0208351 | A1 | 8/2010 | Nofi et al. | 359/589 |
| 2012/0001116 | A1 | 1/2012 | Raksha et al. | 252/62.55 |

OPTICALLY VARIABLE DEVICE COMPRISING MAGNETIC FLAKES

CROSS-REFERENCE TO RELATED APPLICATIONS

The present invention claims priority from U.S. Patent Application No. 61/992,093 filed May 12, 2014, which is incorporated herein by reference.

TECHNICAL FIELD

The present disclosure relates to optically variable devices, and in particular to optically variable devices including magnetically alignable flakes.

BACKGROUND

Optically variable devices are optical devices whose optical performance depends on angle of incidence of illuminating light or angle of observation. A common example of an optically variable device is an iridescent security feature used as an anti-counterfeiting measure on banknotes, credit cards, stock certificates, government-issued identification documents, etc. An optically variable device may provide a visually varying image, for example an illusory three-dimensional (3D) image, a color-shifting image, or both. Such an image is difficult to counterfeit without knowledge of a specific recipe used to manufacture the optical variable device providing the image.

Optically variable devices may be made by coating a surface with an ink or paint including flat platelet-like reflective and, or color-shifting particles. Such surfaces show higher reflectance and brighter colors than surfaces coated with a paint or ink containing conventional pigments. Substrates painted or printed with color-shifting flaked pigments may show change of color when viewed at different angles.

Flaked pigments may contain a material that is magnetically sensitive, so as to be alignable or orientable in an applied magnetic field. Such flakes may be manufactured from a combination of magnetic and non-magnetic materials and mixed with a paint or ink vehicle in the production of magnetic paints or inks. A feature of these products is the ability of the flakes to become oriented along the lines of an applied field inside of a layer of liquid paint or ink, while substantially remaining in this position after drying or curing of the paint or ink vehicle. Relative orientation of the flake and its major dimension with respect to the coated surface determines the level of reflectance or its direction and, or may determine angle-dependent color or brightness of the paint or ink.

By way of example, Phillips et al. in U.S. Pat. No. 6,808,806 disclose methods and devices for producing color-shifting images on coated articles using magnetically alignable flakes including color-shifting coatings. The color-shifting images are defined by the magnetic field applied to the coatings as the coatings are dried or cured. For example, a sheet magnet shaped as a symbol, a letter, or another indicia may be brought in close proximity to the coating during cure. After the coating is cured, the sheet magnet is removed, and the indicia may be seen as a color-shifting image on the coating. The magnetic field application may be adapted for modern printing environments; for example, Raksha et al. in US Patent Application Publication 2005/0106367 disclose a method and apparatus for orienting magnetic flakes in high-speed, linear printing operation.

A 3D illusive image may also be formed on the painted product by applying a spatially varying magnetic field to the surface of the product while the paint still is in the liquid state. When the paint is cured and the magnetic field is removed, the 3D illusive image remains visible on the surface of the painted product. The 3D illusive image appears because light rays incident on the paint layer are influenced differently by differently oriented magnetic particles. Raksha et al. in U.S. Pat. No. 7,934,451 disclose a method and apparatus to orient magnetic flakes in desired 3D patterns in a high-speed linear printing apparatus.

Despite interesting and often intriguing optical effects produced by solidified suspensions of magnetic flakes, their application in optical security devices has been somewhat limited, in particular for banknotes. The application of magnetically alignable flake suspensions in banknotes and other valuable documents may be hindered by a poor compatibility of two main printing processes mostly used in manufacturing of banknotes—offset printing and Intaglio printing—with magnetically alignable particle suspensions. An offset printing process typically produces a very thin ink film thickness, and as such, cannot transfer large magnetic particles, for example particles that are 30 micrometers in size. An Intaglio printing process typically uses a highly viscous ink, which does not allow efficient alignment of magnetic particles suspended in the ink, at least without taking special measures to lessen the viscosity of the ink while applying a magnetic field, as is disclosed by Raksha et al. in U.S. Pat. No. 8,211,509.

SUMMARY

In accordance with an aspect of the disclosure, a thickness of a layer including oriented magnetic flakes may be reduced by applying magnetic flakes absent any liquid binder or carrier to an adhesive surface in the presence of magnetic field, which orients the magnetic flakes. For example, magnetic particles may be dusted or blown onto an adhesive surface in the presence of the magnetic field, causing the magnetic flakes to adhere to the adhesive surface in an oriented manner. Then, a thin coating layer may be applied to the oriented magnetic particles adhered to the adhesive surface. The coating layer is cured to maintain the orientation of the magnetic flakes.

In accordance with an aspect of the disclosure, there is provided a method of manufacturing an optically variable device, the method comprising:

providing a substrate with an first adhesive layer thereon;

applying a first magnetic field to the first adhesive layer and providing magnetic flakes absent a liquid carrier or binder onto the first adhesive layer in the presence of the first magnetic field so that the magnetic flakes oriented by the first magnetic field adhere to the first adhesive layer;

coating the first adhesive layer and the magnetic flakes adhered thereto with a coating layer; and curing the coating layer, so as to substantially maintain orientation of the magnetic flakes.

The first adhesive layer may be only partially cured during depositing the magnetic flakes thereon. The substrate may include a release layer, in which case the coating layer may be adhered to a second substrate, and the release layer may be removed, to obtain a "flipped" orientation pattern of the magnetic flakes. The method may be adaptable to high printing speeds.

In one embodiment, a second adhesive layer may be provided on top of the first adhesive layer or beside the first adhesive layer. A second magnetic field may be applied to the second adhesive layer, and second magnetic flakes absent a liquid carrier or binder may be provided onto the second adhesive layer in the presence of the second magnetic field, so that the second magnetic flakes oriented by the second magnetic field adhere to the second adhesive layer. After this, the second adhesive layer may be cured.

In accordance with the disclosure, there is further provided a method of manufacturing an optically variable device, the method comprising:

providing a substrate with an adhesive layer thereon;

applying a magnetic field to the adhesive layer;

separately applying magnetic flakes and a coating to the adhesive layer, by initially applying the magnetic flakes absent a liquid carrier, causing the magnetic flakes to adhere to the adhesive layer, wherein the magnetic flakes adhered to the adhesive layer are oriented by the magnetic field; and, after the magnetic flakes have been applied to the adhesive layer, applying the coating to the adhesive layer so as to form a coating layer on the adhesive layer, wherein the coating layer encapsulates the magnetic flakes; and curing the coating layer, so as to substantially maintain orientation of the magnetic flakes.

In accordance with the disclosure, there is further provided an optically variable device comprising a substrate; an adhesive layer over the substrate; a plurality of oriented magnetic flakes supported by the adhesive layer; and a coating layer over the substrate adjacent the adhesive layer. The coating may encapsulate the magnetic flakes extending from the adhesive layer, so that a portion of each one of the plurality of oriented magnetic flakes is adhesively attached to the adhesive layer, and a remaining portion of the same magnetic flake extends out of the adhesive layer into the coating layer.

In one embodiment, the adhesive layer is disposed on the substrate, and the coating layer is disposed on the adhesive layer. The coating covering the flakes on the adhesive layer may be of the same material as the adhesive layer, or may be a different material. The magnetic flakes may be partially disposed in the adhesive layer. In one embodiment, the magnetic flakes are reflective, and may include color-shifting multilayer coatings. By carefully selecting magnets to generate the magnetic fields, the magnetic flakes may be oriented so as to create a visual appearance of a 3D object such as a hemisphere, a cone, a funnel, a combination of different images obtained at separated stations, etc. The magnetic alignment may be repeated to create other images on top or aside a first image.

BRIEF DESCRIPTION OF THE DRAWINGS

Exemplary embodiments will now be described in conjunction with the drawings, in which.

DETAILED DESCRIPTION

While the present teachings are described in conjunction with various embodiments and examples, it is not intended that the present teachings be limited to such embodiments. On the contrary, the present teachings encompass various alternatives and equivalents, as will be appreciated by those of skill in the art.

Figure 1:
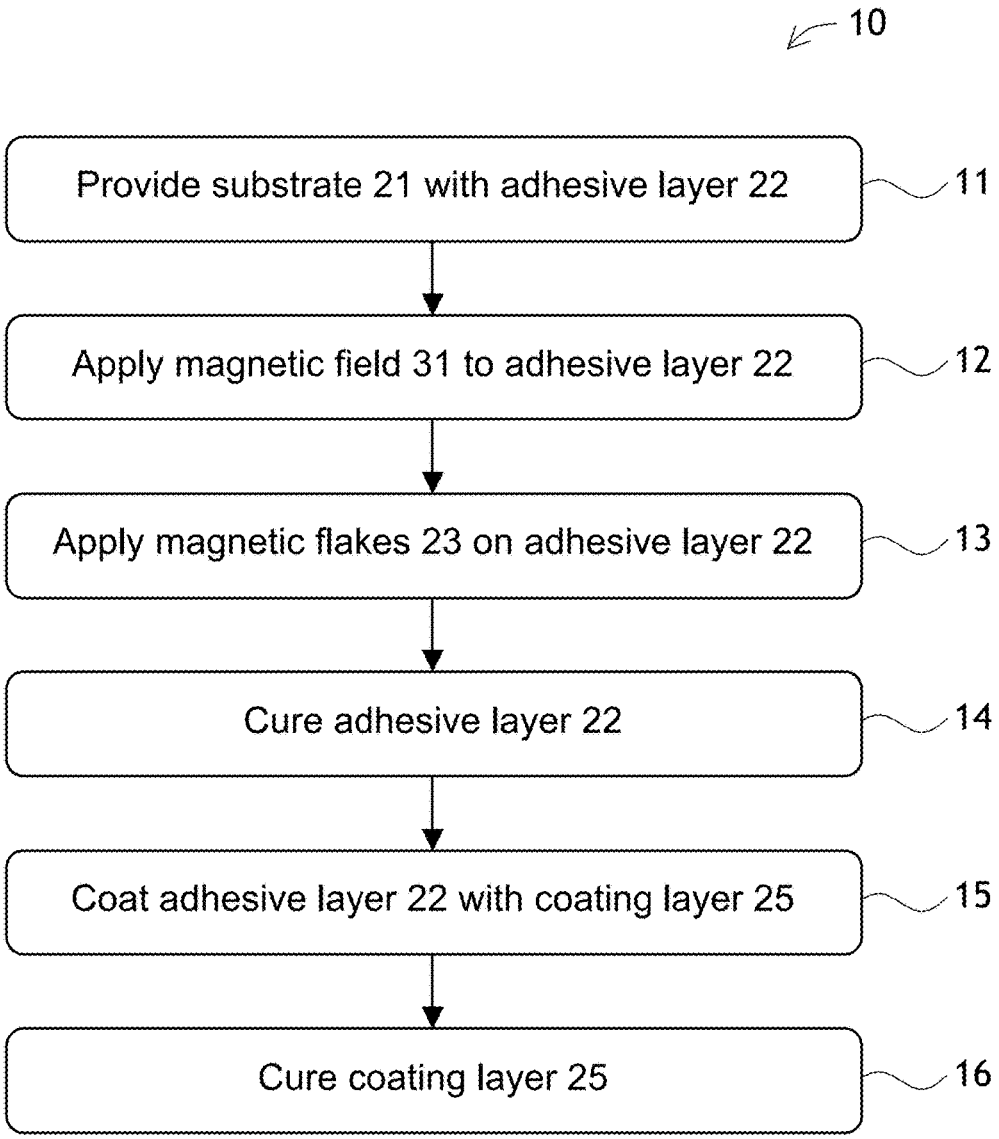
FIG. 1 is a flow chart of a method of manufacturing an optically varying device according to the present disclosure.
Figure 2A:
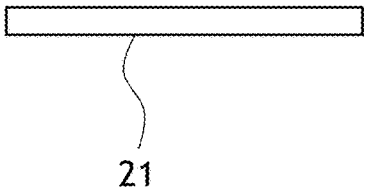
FIGS. 2A-2H are side cross-sectional views of an optically variable device of the present disclosure at different progressive stages of manufacturing.
Figure 2B:
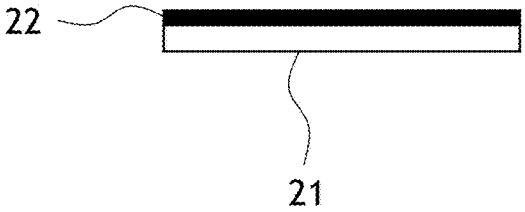
Figure 2C:
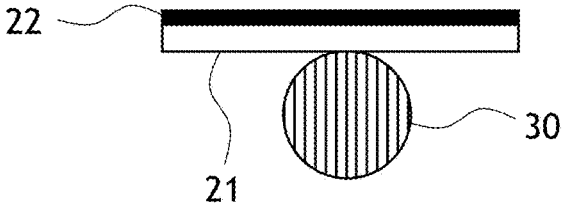
Figure 2D:
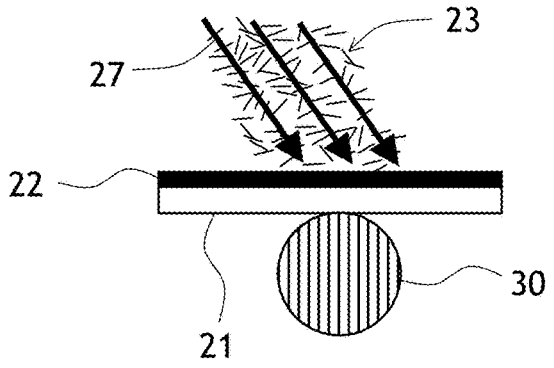
Figure 2E:
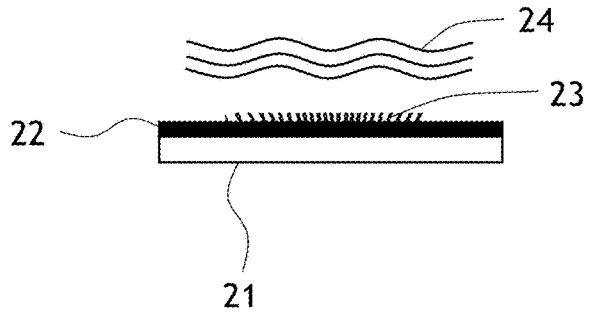
Figure 2F:
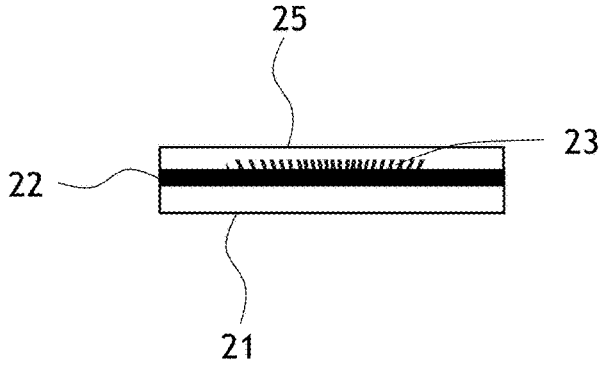
Figure 2G:
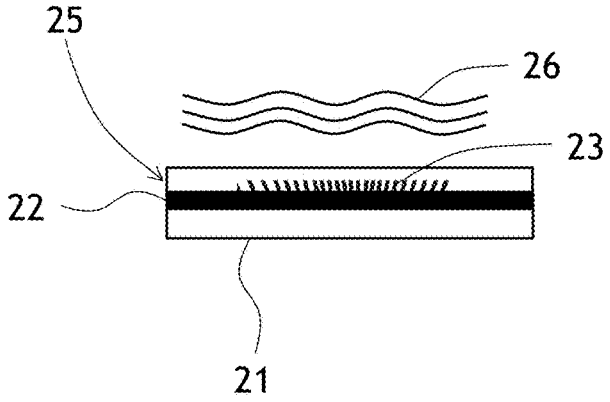
Figure 2H:
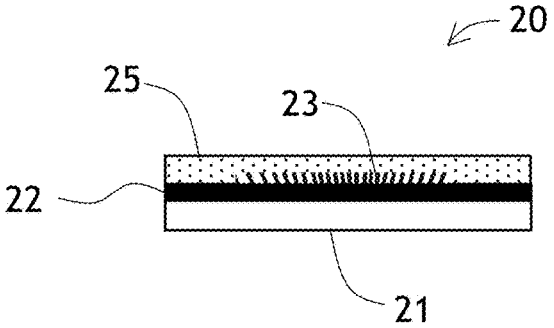
Figure 3A:
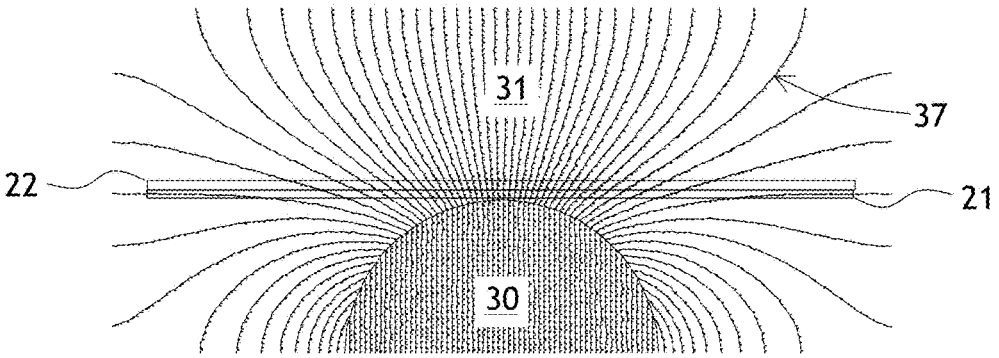
FIG. 3A is a schematic side cross-sectional view of a magnet underneath a substrate, showing lines of magnetic field of the magnet.

Referring to FIG. 1 with further reference to FIGS. 2A-2H, 3A, and 3B, a method 10 (FIG. 1) of manufacturing an optically variable device 20 (the manufactured device is shown in FIG. 2H) may include a step 11 of providing a substrate 21 with an adhesive layer 22 (FIG. 2B) on the substrate 21 (FIGS. 2A, 2B), which may be deposited, for example, by coating or printing. The substrate 21 may also be provided with the adhesive layer 22 already present on the substrate 21, and the adhesive 22 may require only activation, for example by heating. In a magnetic field application step 12, a magnetic field 31 (FIG. 3A) is applied, for example by providing a permanent magnet 30 (FIGS. 2C and 3A) under the substrate 21 (FIGS. 2C and 3A). An electromagnet may also be used. The magnetic field 31 generated by the magnet 30 extends through and over the adhesive layer 22 (FIG. 3A).

Figure 3B:
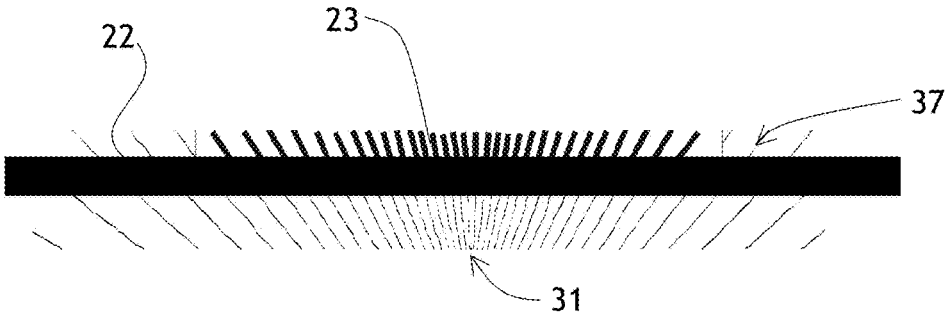
FIG. 3B is a schematic side cross-sectional view of a substrate supporting magnetic flakes aligned along the magnetic field lines of the magnet shown in FIG. 3A.

In a flake application step 13, magnetic flakes 23 are applied to the adhesive layer 22, for example, by blowing the magnetic flakes 23 onto the adhesive layer 22 using a stream 27 of gas e.g. air, argon, or nitrogen, having the magnetic flakes 23 suspended in the stream 27 of gas and carried by the stream 27 of gas, as shown schematically in FIG. 2D. Alternatively, the magnetic flakes 23 may be provided by dusting, or spreading the magnetic flakes 23 with the help of mechanical means, such as a blade, for example. Upon reaching the adhesive layer 22, the magnetic flakes 23 may adhere to the adhesive layer 22 (FIG. 2E). The magnetic field 31 causes the magnetic flakes 23 to become oriented or aligned along field lines 37 of the magnetic field 31 (FIG. 3B).

Preferably, the magnetic flakes 23 are applied to the adhesive layer 22 in presence of the magnetic field 31. In case of dusting of deposition with gaseous stream, the magnetic field 31 facilitates orientation of the magnetic flakes 23 during their flight towards the adhesive layer 22, so that the magnetic flakes 23 may land onto the adhesive layer 22 already oriented along the magnetic field 31 lines. If the magnetic field 31 is not applied in the flake application step 13, some of the magnetic flakes 23 may land flat on and adhere flat to the adhesive layer 22, which may make hinder their further orientation of the magnetic flakes 23 by the magnetic field 31.

In an optional adhesive layer curing step 14 of the method 10 (FIG. 1), the adhesive layer 22 may be fully cured e.g. by applying heat 24 (FIG. 2E), ultraviolet (UV) light, etc., after application of the magnetic flakes 23 in the flake application step 13. The adhesive layer 22 may be already partially cured (partially uncured) prior to application of the magnetic flakes 23.

In a coating step 15 of the method 10 (FIG. 1), the adhesive layer 22 having the magnetic flakes 23 adhered to the adhesive layer 22, or anchored in the adhesive layer 22, is coated with a coating layer 25 (FIG. 2F), for example a transparent adhesive layer or a varnish layer. The coating layer 25 may also include a semi-transparent colored layer in combination with the magnetic flakes 23, which may be colored or non-colored. In a curing step 16, the coating layer 25 is cured e.g. by applying heat 26, UV light, or both (FIG. 2G), so as to substantially preserve the orientation of the magnetic flakes 23 after the magnetic field 31 is removed. In this step, the adhesive layer 22 may also be fully cured, from a partially or fully uncured state.

A second adhesive layer, not shown, may be provided on top of the adhesive layer 22 or beside the adhesive layer 22. A second magnetic field, not shown, may be applied to the second adhesive layer, and second magnetic flakes may be provided onto the second adhesive layer in the presence of the second magnetic field so that the second magnetic flakes oriented by the second magnetic field adhere to the second adhesive layer. The second magnetic flakes may also be absent a liquid carrier or binder. The second magnetic field may be different from the magnetic field 31, for example the second magnetic field may have a different orientation or strength, or field lines pattern. The second magnetic flakes may also be different from the magnetic flakes 23, for example the second magnetic flakes may have different color, size, material composition, etc. Magnetic fields and different flake types may be applied consecutively to obtain multi-color 3D indicia.

Figure 2I:
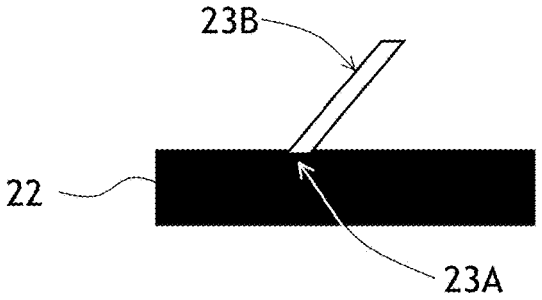
FIG. 2I is a magnified view of a single flake of the optically variable device of FIG. 2H, attached to an adhesive layer.

The manufactured optically variable device 20 is shown in FIG. 2H. The optically variable device 20 includes the substrate 21, the adhesive layer 22 over the substrate 21, and the magnetic flakes 23 supported by the adhesive layer 22. The magnetic flakes 23 are adhered to the substrate 21, and may appear extending from the substrate 32. The magnetic flakes 23 are oriented by the magnetic field 31 (FIGS. 3A and 3B). Herein, the term "oriented" means that the magnetic flakes 23 are aligned, that is, disposed in a non-random, coordinated fashion. The coating layer 25 extends over the substrate 21 adjacent the adhesive layer 22, encapsulating the magnetic flakes 23. As seen in FIG. 2I, a portion 23A of the magnetic flake 23 is adhesively attached to the adhesive layer 22, and another portion 23B of the same magnetic flake 23 extends out of the adhesive layer 22 into the coating layer 25. In one embodiment, the magnetic field 31 may be configured to have the field lines parallel to the surface of the substrate 21. Most of the flakes 23 planarized by the magnetic field 31 would have one major side in contact with the adhesive layer 22, and another major side in contact with the coating layer 25.

Application of the magnetic flakes 23 and the coating layer 25 in separate steps may enable resulting optically variable devices 20 to remain quite thin. Essentially, the minimal thickness of the coating layer 25 is limited by size of individual flakes 23. For instance, for <20 micrometer sized flakes, the coating layer 25 thickness may remain as small as 20-40 micrometers. In the flake application step 13, the magnetic flakes 23 are applied to the adhesive layer 22 absent the coating layer 25. The magnetic flakes 23 may extend from the adhesive layer 22 e.g. by 15-20 micrometers. Once the magnetic flakes 23 adhere to the adhesive layer 22, being oriented along the field lines 37 of the magnetic field 31, the coating layer 25 may be applied to the adhesive layer 22 in the coating step 15, to encapsulate the magnetic flakes 23 within the coating layer 25, which can remain as thin as 100 micrometers. It is preferred that the coating layer 25 be substantially transparent to visible light, being colorless or colored, depending on required optical performance of the optically variable device 20. Smaller magnetic flakes 23, for example having an average size of 5 to 10 micrometers, may be preferable, depending on a particular printing application.

The magnetic flakes 23 may be reflective, e.g. the magnetic flakes 23 may have an optical reflectivity at visible wavelengths between 380 nm and 750 nm of at least 50%. Reflective magnetic flakes 23, when oriented, for example by a spherical or conical permanent magnet, may create a visual appearance of a metallic 3D-looking object, due to apparent reflectivity varying with illumination angle and, or observation angle. The magnetic flakes 23 may also include pearlescent or multilayer color-shifting coatings, which change color upon a change of angle of observation or illumination. Flakes which include multilayer color-shifting coatings may create a visual appearance of color-shifting 3D-looking objects, and may be particularly attractive for optical security applications. The magnetic flakes 23 may also have low reflectivity, so as to appear dark or black on a light background.

The shape of 3D-looking objects depends on shape and magnetization direction of the magnet 30 placed under the substrate 21 (FIG. 3A). The magnet 30 may be shaped and oriented to create the magnetic field 31 of a particular configuration. Furthermore, the resulting 3D looking shape may be inverted by flipping over the structure of the optically variable device 20.

Figure 4A:
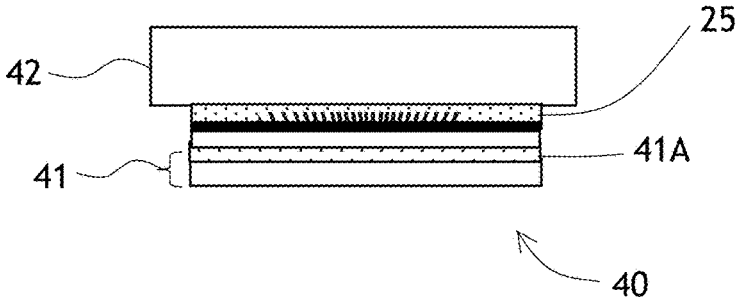
FIGS. 4A to 4C are side cross-sectional views of an inverted optically variable device of the present disclosure at different progressive stages of manufacturing.
Figure 4B:
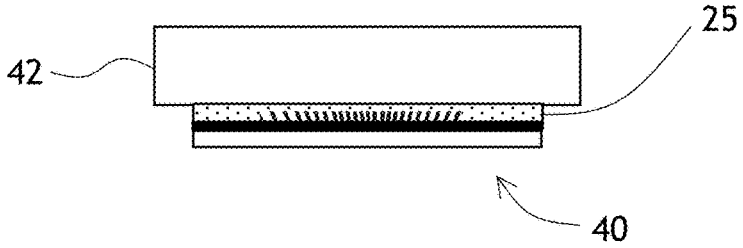
Figure 4C:
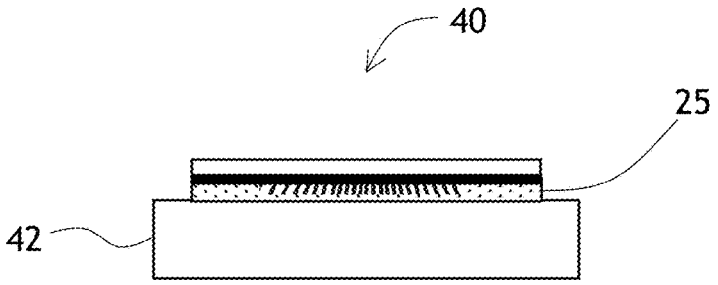

Turning to FIGS. 4A-4C with further reference to FIG. 1, an optically variable device 40 may be manufactured using the method 10 of FIG. 1. A substrate 41 of the optically variable device 40 includes a release layer 41A. The coating layer 25 may be adhered to a second substrate 42 as shown in FIG. 4A. The release layer 41A may be then removed as shown in FIG. 4B, resulting in the optically variable device 40 being supported upside down by the second substrate 42, as shown in FIG. 4C.

Figure 5:
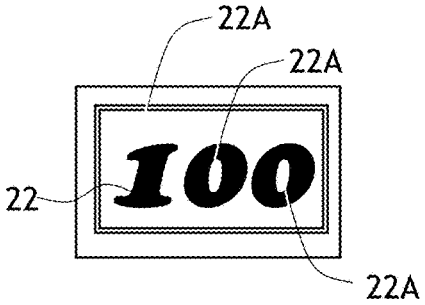
FIG. 5 is a schematic plan view of an optically varying device, in which the adhesive layer is patterned to form a banknote denomination "100"

Referring to FIG. 5, the adhesive layer 22 may include voids 22A in the adhesive layer 22, e.g. forming visible indicia such as the number "100", for example. The voids 22A in the adhesive layer 22 may be formed using any suitable method, such as silk screen printing or other printing methods, lithography, etc. Once the magnetic flakes 23 are applied to the adhesive layer 22 in the flake application step 13 of the method 10, the magnetic flakes applied to the voids 22A may be removed, for example, by directing a flow of gas on the voids 22A or by shaking. Masking may be applied while printing the adhesive, and, or providing the magnetic flakes 23, and, or providing further coating. For added security, the magnetic flakes 23 may optionally include a diffractive pattern and, or covert identification indicia discernible under magnification.

Several prototypes of the optically variable device 20 (FIG. 2H) have been manufactured, and optically variable performance of the prototypes has been evaluated. Referring to FIGS. 6A, 6B, and 7A-7C, with further reference to FIG. 2H, a plan-view photograph (FIG. 6A) of a prototype of the optically variable device 20 (FIG. 2H) is shown. The adhesive layer 22 of the prototype of FIG. 6A included an adhesive ink layer, the magnetic flakes 23 included a color-shifting magnetic pigment changing color from gold at normal angle of viewing to green color at oblique angles. The coating layer 25 included varnish. The adhesive ink was cured prior to application of the varnish.

Figure 6A:
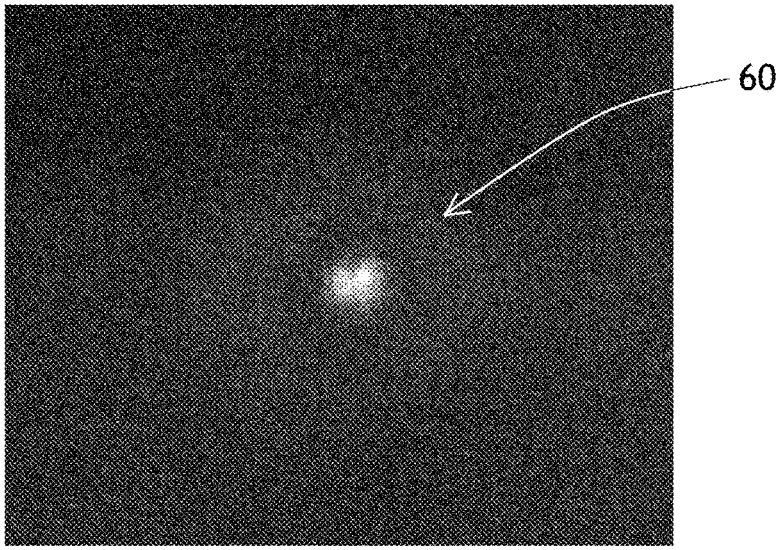
FIG. 6A is a plan-view photograph of an optically variable device, in which magnetic flakes have been aligned on a layer of adhesive ink with a spherical-cylindrical magnet pair including a cylindrical magnet and a spherical magnet centered on top of the cylindrical magnet.
Figure 6B:
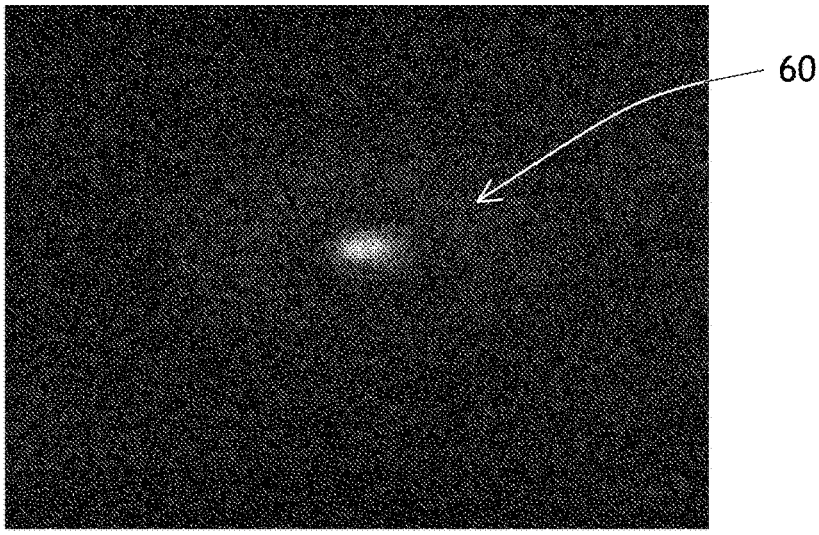
FIG. 6B is an oblique-view photograph of the optically variable device of FIG. 6A.
Figure 7A:
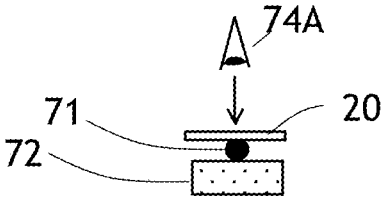
FIG. 7A is a side cross-sectional view of the spherical-cylindrical magnet pair used to align magnetic flakes of the prototypes of FIGS. 6A and 6B, showing a viewing direction of FIG. 6A.
Figure 7B:
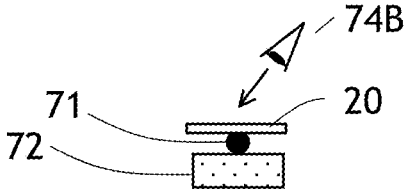
FIG. 7B is a side cross-sectional view of the spherical-cylindrical magnet pair used to align magnetic flakes of the prototypes of FIGS. 6A and 6B, showing a viewing direction of FIG. 6B.
Figure 7C:
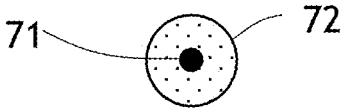
FIG. 7C is a top view of the spherical-cylindrical magnet pair used to align magnetic flakes of the prototypes of FIGS. 6A and 6B.

To provide a 3D appearance of a metal ball image 60 seen in the photograph of FIG. 6A, a spherical-cylindrical magnet pair including a spherical magnet 71 atop a cylindrical magnet 72 (FIG. 7A) has been placed under the optically variable device 20. The direction of viewing of FIG. 6A is shown in FIG. 7A at 74A. The direction of viewing 74A is shown in FIGS. 7A and 7B superimposed with the spherical 71 and cylindrical 72 magnets only to illustrate the geometry of the magnets in relation to the geometry of observation. For an actual observation, the spherical 71-cylindrical 72 magnet pair was removed. In FIG. 6B, the same prototype is viewed at an oblique angle shown in FIG. 7B at 74B. FIG. 7C shows a plan view of the spherical 71-cylindrical 72 magnet pair.

Figure 8A:
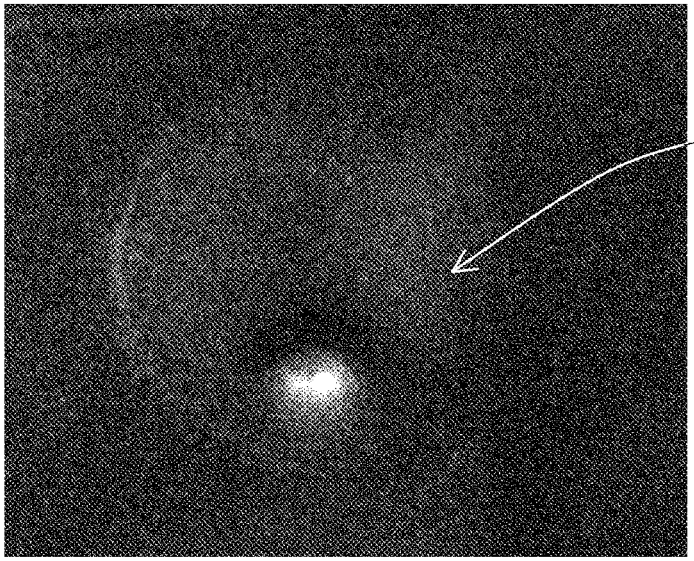
FIG. 8A is a plan-view photograph of an optically variable device, in which magnetic flakes have been aligned on a layer of adhesive ink with a spherical-cylindrical magnet pair including a spherical magnet atop of and near an edge of a cylindrical magnet.
Figure 8B:
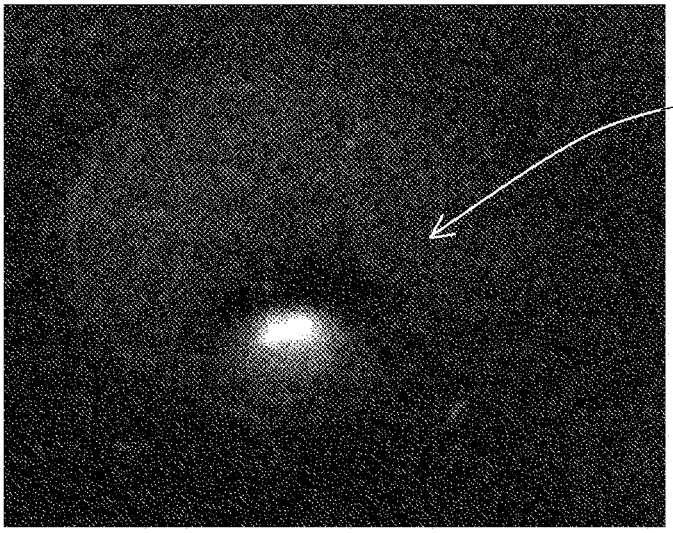
FIG. 8B is an oblique-view photograph of the optically variable device of FIG. 8A.
Figure 9A:
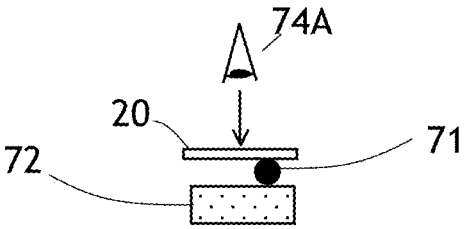
FIG. 9A is a side cross-sectional view of the spherical-cylindrical magnet pair used to align magnetic flakes of the prototypes of FIGS. 8A and 8B, showing a viewing direction of FIG. 8A.
Figure 9B:
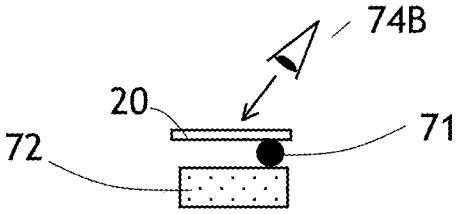
FIG. 9B is a side cross-sectional view of the spherical-cylindrical magnet pair used to align magnetic flakes of the prototypes of FIGS. 8A and 8B, showing a viewing direction of FIG. 8B.
Figure 9C:
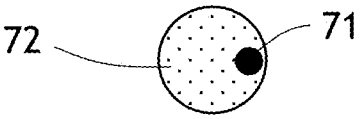
FIG. 9C is a plan view of the spherical-cylindrical magnet pair used to align magnetic flakes of the prototypes of FIGS. 8A and 8B.

Referring to FIGS. 8A, 8B, and 9A-9C, with further reference to FIGS. 2H and 6A, a prototype of FIG. 8A has a similar layer structure as the prototype of FIG. 6A, the only difference being the position of the spherical magnet 71 (FIG. 9A) in the magnet pair used to orient the magnetic flakes 23 (FIG. 2H). In FIG. 9A, the direction of viewing is shown at 74A. In FIGS. 9A and 9B, the spherical magnet 71 is positioned close to an edge of the cylindrical magnet 72, resulting in a shifted position of a metal ball image 80 in FIGS. 8A and 8B. In FIG. 8B, the prototype of FIG. 8A is viewed at an oblique angle, as shown in FIG. 9B at 74B. FIG. 9C shows a plan view of the spherical 71-cylindrical 72 magnet pair.

Figure 10A:
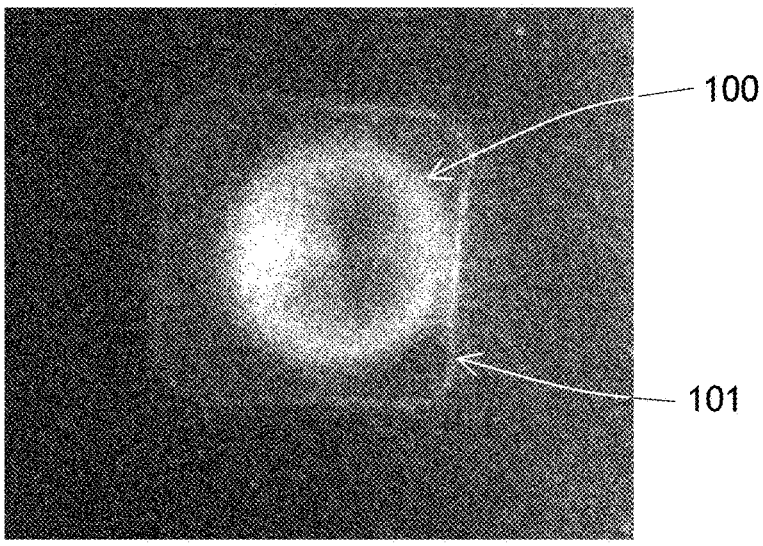
FIG. 10A is a plan-view photograph of an optically variable device, in which magnetic flakes have been aligned on a layer of adhesive ink with a cylindrical-rectangular magnet pair including a cylindrical magnet on top of a rectangular magnet.
Figure 10B:
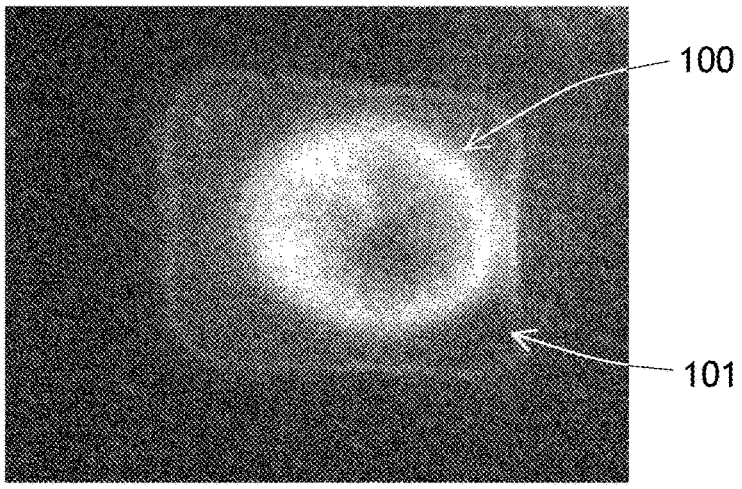
FIG. 10B is an oblique-view photograph of the optically variable device of FIG. 10A.
Figure 11A:
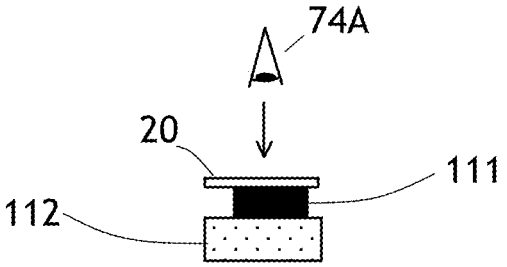
FIG. 11A is a side cross-sectional view of the cylindrical-rectangular magnet pair used to align magnetic flakes of the prototypes of FIGS. 10A and 10B, showing a viewing direction of FIG. 10A.
Figure 11B:
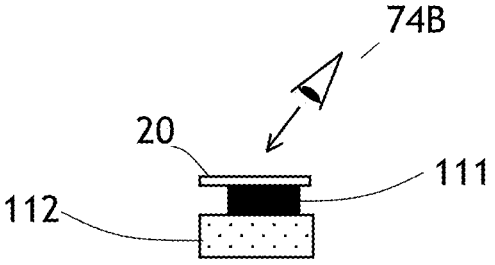
FIG. 11B is a side cross-sectional view of the cylindrical-rectangular magnet pair used to align magnetic flakes of the prototypes of FIGS. 10A and 10B, showing a viewing direction of FIG. 10B.
Figure 11C:
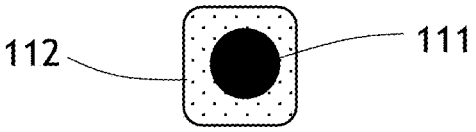
FIG. 11C is a plan view of the cylindrical-rectangular magnet pair used to align magnetic flakes of the prototypes of FIGS. 10A and 10B.

Turning to FIGS. 10A, 10B, and 11A-11C, with further reference to FIGS. 2H and 6A, a prototype of FIG. 10A has a similar layer structure as the prototype of FIG. 6A, the only difference being that instead of the spherical 71-cylindrical 72 magnet pair, a cylindrical 111—rectangular 112 magnet pair (FIGS. 11A-11C) is used to orient the magnetic flakes 23 (FIG. 2H) to form an image of a 3D cone 100 within a round-cornered rectangle 101 (FIGS. 10A, 10B). The direction of viewing corresponding to FIG. 10A is shown at in FIG. 11A at 74A. In FIG. 10B, the same prototype is viewed at an oblique viewing angle shown in FIG. 11B at 74B. FIG. 11C shows a plan view of the cylindrical 111—rectangular 112 magnet pair.

The cylindrical 111—rectangular 112 magnet pair shown in FIGS. 11A-11C has been used to orient the magnetic flakes 23 in prototypes of FIGS. 12A, 12B, 13A, 13B, 14A, and 14B described below. These prototypes have been manufactured with different layer materials, using varying layer curing schedules.

Figure 12A:
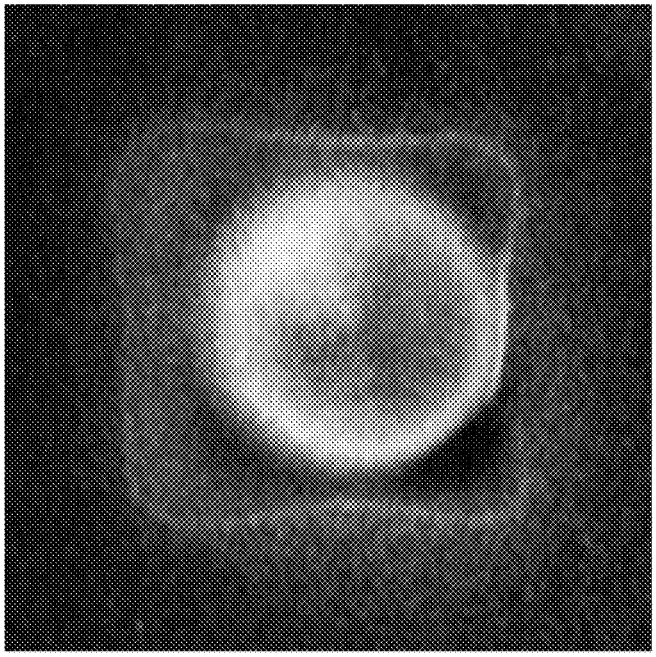
FIG. 12A is a plan-view photograph of an optically variable device, in which magnetic flakes have been aligned on a layer of varnish with the cylindrical-rectangular magnet pair of FIGS. 11A-11C.
Figure 12B:
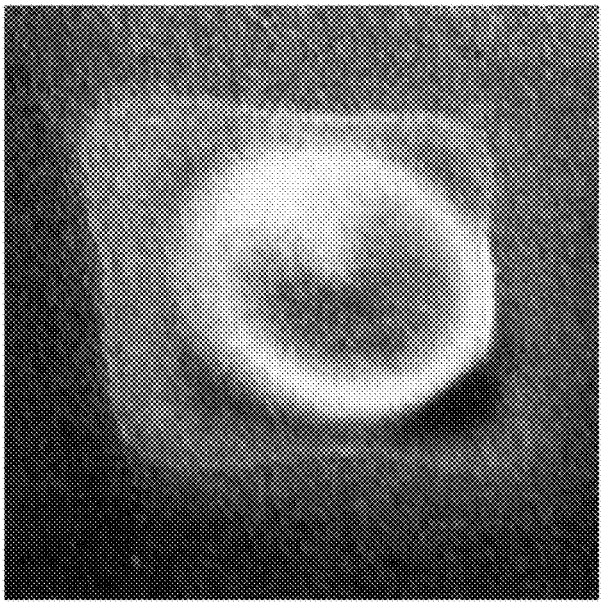
FIG. 12B is an oblique-view photograph of the optically variable device of FIG. 12A.

In a prototype shown in FIGS. 12A and 12B, the adhesive layer 22 (FIG. 2H) included not adhesive ink but a same varnish material as the coating layer 25. The varnish of the adhesive layer 22 was cured after application of the Go/Gr color-shifting magnetic pigment flakes. The 3D effect was present, as can be seen by comparing FIGS. 12A and 12B, when the varnish was used in the adhesive layer 22.

Figure 13A:
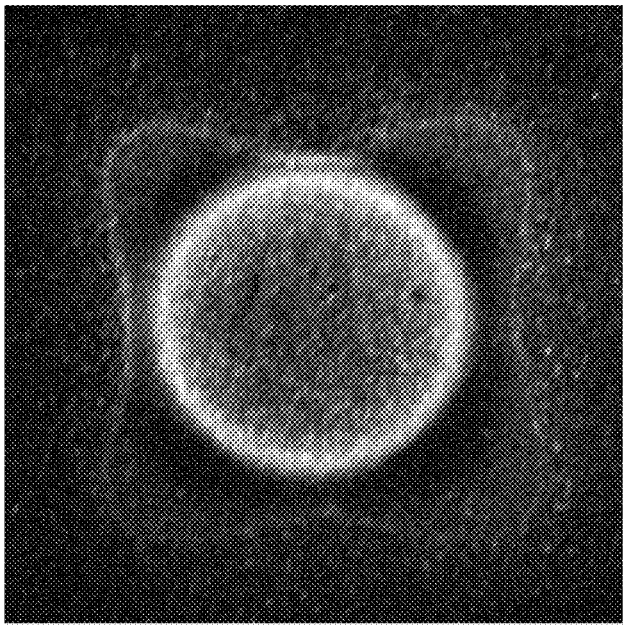
FIG. 13A is a plan-view photograph of an optically variable device, in which magnetic flakes have been applied to a layer of a UV-cured adhesive ink with the cylindrical-rectangular magnet pair of FIGS. 11A-11C.
Figure 13B:
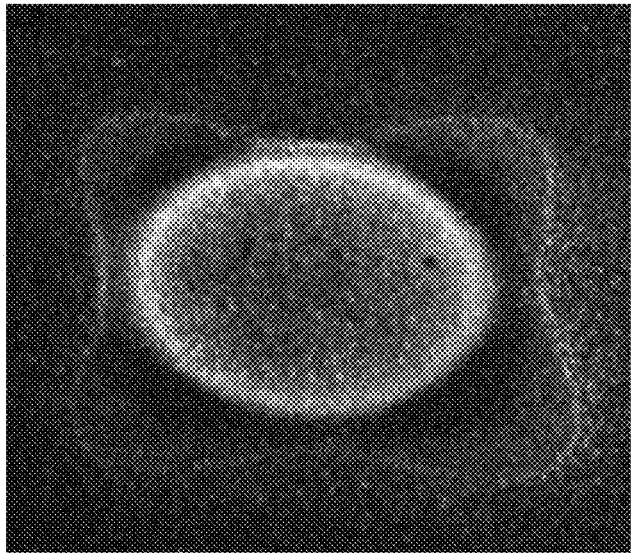
FIG. 13B is an oblique-view photograph of the optically variable device of FIG. 13A.
Figure 14A:
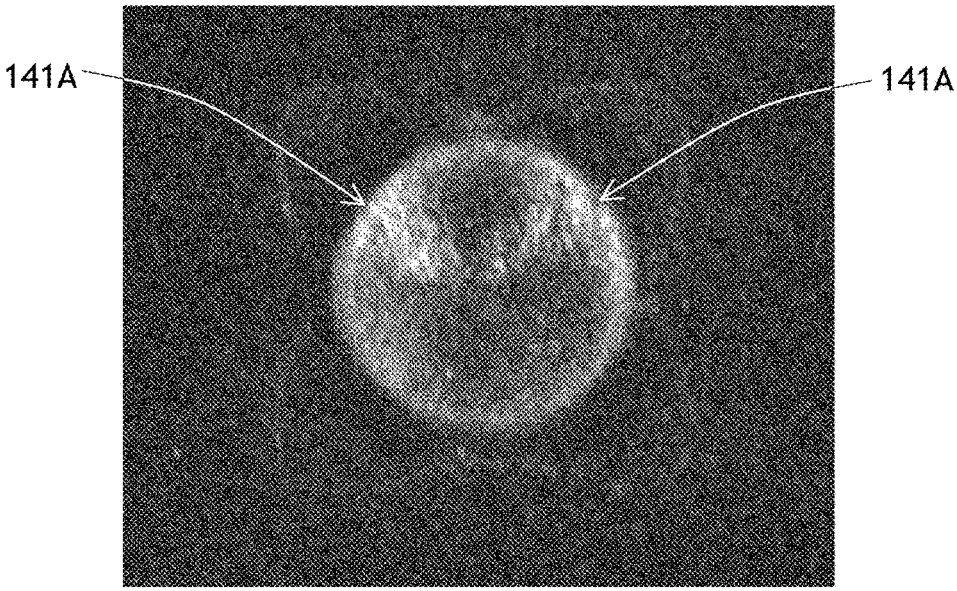
FIG. 14A is a plan-view photograph of an optically variable device, in which magnetic flakes have been applied to a layer of an uncured adhesive ink with the rectangular-cylindrical magnet pair of FIGS. 11A-11C.
Figure 14B:
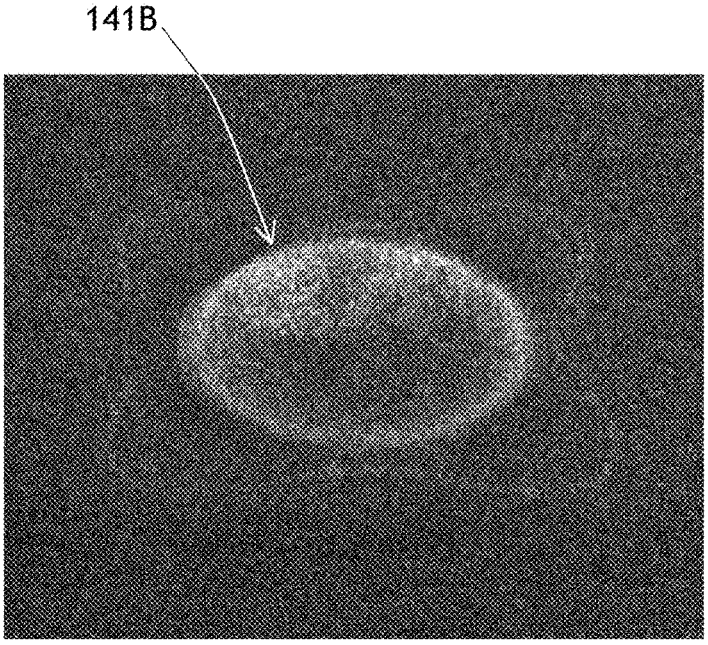
FIG. 14B is an oblique-view photograph of the optically variable device of FIG. 14A.

In a prototype shown in FIGS. 13A and 13B, a UV-curable adhesive ink was used to form the adhesive layer 22. The UV-curable adhesive ink was pre-cured by UV light prior to application of achromatic magnetic flakes 23, which included 5 layers $MgF_2$/Al/magnetic layer/Al/$MgF_2$. The 3D cone was not observed. In a prototype shown in FIGS. 14A and 14B, the UV-curable adhesive ink was not pre-cured prior to application of the achromatic magnetic flakes 23. Rather, the UV-curable adhesive ink was cured after the application of the achromatic magnetic flakes 23. 3D cone features 141A (FIG. 14A) and 141B (FIG. 14B) were observed with this prototype. Therefore, it may be preferable to cure the adhesive layer 22 (FIG. 2E and step 14 of the method 10 of FIG. 1) after application of the magnetic flakes 23 on the adhesive layer 22 (FIG. 2D and step 13 of the method 10 of FIG. 1).

The present disclosure is not to be limited in scope by the specific embodiments described herein. Indeed, other various embodiments and modifications, in addition to those described herein, will be apparent to those of ordinary skill in the art from the foregoing description and accompanying drawings. Thus, such other embodiments and modifications are intended to fall within the scope of the present disclosure. Further, although the present disclosure has been described herein in the context of a particular implementation in a particular environment for a particular purpose, those of ordinary skill in the art will recognize that its usefulness is not limited thereto and that the present disclosure may be beneficially implemented in any number of environments for any number of purposes. Accordingly, the claims set forth below should be construed in view of the full breadth and spirit of the present disclosure as described herein.

What is claimed is:

1. A method of manufacturing an optically variable device, the method comprising:

providing a substrate with an first adhesive layer thereon;

applying a first magnetic field to the first adhesive layer and providing magnetic flakes absent a liquid carrier or binder onto the first adhesive layer in the presence of the first magnetic field so that the magnetic flakes oriented by the first magnetic field adhere to the first adhesive layer;

coating the first adhesive layer and the magnetic flakes adhered thereto with a coating layer; and curing the coating layer, so as to substantially maintain orientation of the magnetic flakes.

2. The method of claim 1, wherein the first adhesive layer is at least partially uncured when the magnetic flakes are provided onto the first adhesive layer, the method further comprising curing the first adhesive layer after the magnetic flakes have adhered thereto.

3. The method of claim 2, wherein the first adhesive and coating layers are cured together.

4. The method of claim 1, wherein the first magnetic field is created by a permanent magnet.

5. The method of claim 4, wherein the permanent magnet is selected to provide a visual appearance of a 3D object on or within the optically variable device.

6. The method of claim 1, wherein the magnetic flakes are provided onto the first adhesive layer while applying the first magnetic field.

7. The method of claim 1, wherein the magnetic flakes are provided onto the first adhesive layer by blowing the magnetic flakes onto the first adhesive layer using a stream of gas comprising the magnetic flakes suspended therein.

8. The method of claim 1, wherein the first adhesive layer comprises voids therein, the method further comprising removing magnetic flakes from the voids by directing a flow of gas on the voids.

9. The method of claim 8, wherein the first adhesive layer comprising the voids therein is formed by printing.

10. The method of claim 1, wherein the magnetic flakes have an optical reflectivity at visible wavelengths between 380 nm and 750 nm of at least 50%.

11. The method of claim 10, wherein the magnetic flakes comprise a multilayer color shifting coating.

12. The method of claim 1, wherein the substrate comprises a release layer, the method further comprising adhering the coating layer to a second substrate and removing the release layer.

13. The method of claim 1, further comprising providing a second adhesive layer on top of the first adhesive layer or beside the first adhesive layer;

applying a second magnetic field to the second adhesive layer, and providing second magnetic flakes absent a liquid carrier or binder onto the second adhesive layer in the presence of the second magnetic field so that the second magnetic flakes oriented by the second magnetic field adhere to the second adhesive layer; and curing the second adhesive layer.

14. The method of claim 13, wherein the second magnetic field is different from the first magnetic field, or wherein the second magnetic flakes are different from the first magnetic flakes.

15. The method of claim 1, wherein the coating layer is substantially transparent or semi-transparent to visible light.

16. The method of claim 15, wherein the coating layer is colored.

17. A method of manufacturing an optically variable device, the method comprising:

providing a substrate with an adhesive layer thereon;

applying a magnetic field to the adhesive layer;

separately applying magnetic flakes and a coating to the adhesive layer, by initially applying the magnetic flakes absent a liquid carrier or binder, causing the magnetic flakes to adhere to the adhesive layer, wherein the magnetic flakes adhered to the adhesive layer are oriented by the magnetic field; and, after the magnetic flakes have been applied to the adhesive layer, applying the coating to the adhesive layer so as to form a coating layer on the adhesive layer, wherein the coating layer encapsulates the magnetic flakes; and curing the coating layer, so as to substantially maintain orientation of the magnetic flakes.

18. An optically variable device comprising:

a substrate;

an adhesive layer over the substrate;

a plurality of oriented magnetic flakes supported by the adhesive layer; and a coating layer over the substrate adjacent the adhesive layer, wherein the coating layer encapsulates the magnetic flakes extending from the adhesive layer, wherein a portion of each one of the plurality of oriented magnetic flakes is adhesively attached to the adhesive layer, and a remaining portion of the same magnetic flake extends out of the adhesive layer into the coating layer.

19. The optically variable device of claim 18, wherein the adhesive layer is disposed on the substrate, and the coating layer is disposed on the adhesive layer.

20. The optically variable device of claim 19, wherein at least some of the plurality of oriented magnetic flakes comprise a multilayer color-shifting coating.

21. The optically variable device of claim 18, wherein the plurality of the oriented magnetic flakes are oriented so as to create a visual appearance of a 3D object.

22. An optical security device comprising an optically variable device of claim 18, wherein the adhesive layer comprises voids therein, so as to form visible indicia.

* * * * *